US012234633B2

(12) United States Patent
Chen et al.

(10) Patent No.: US 12,234,633 B2
(45) Date of Patent: Feb. 25, 2025

(54) PREFABRICATED REINFORCED CONCRETE BEAM-COLUMN CONNECTING STRUCTURE AND CONSTRUCTION METHOD THEREOF

(71) Applicant: HAINAN UNIVERSITY, Hainan (CN)

(72) Inventors: Yun Chen, Hainan (CN); Jia Qin, Hainan (CN); Zhikang Chen, Hainan (CN)

(73) Assignee: HAINAN UNIVERSITY, Hainan (CN)

( * ) Notice: Subject to any disclaimer, the term of this patent is extended or adjusted under 35 U.S.C. 154(b) by 0 days.

(21) Appl. No.: 18/503,203

(22) Filed: Nov. 7, 2023

(65) Prior Publication Data

US 2024/0159038 A1 May 16, 2024

(30) Foreign Application Priority Data

Nov. 10, 2022 (CN) ..... 202211409509.2

(51) Int. Cl.
*E04B 1/21* (2006.01)
*E04B 1/30* (2006.01)

(52) U.S. Cl.
CPC ..... *E04B 1/215* (2013.01)

(58) Field of Classification Search
CPC ..... E04B 1/215
USPC ..... 52/698
See application file for complete search history.

(56) References Cited

U.S. PATENT DOCUMENTS 1,948,691 A * 2/1934 Bauer ..... H01H 9/44 52/649.6
2,115,949 A * 5/1938 Gurber ..... E04B 1/215 52/283
2,208,814 A * 7/1940 Peabody ..... E04B 2/64 52/601
2,569,669 A * 10/1951 Henderson ..... E04B 1/21 52/283

(Continued)

FOREIGN PATENT DOCUMENTS

CN 106381925 A * 2/2017 ..... E04B 1/215
CN 106639495 A * 5/2017 ..... E04H 12/12

(Continued)

*Primary Examiner* — Jessica L Laux
*Assistant Examiner* — Joseph J. Sadlon
(74) *Attorney, Agent, or Firm* — Yue (Robert) Xu; Apex Attorneys at Law, LLP

(57) ABSTRACT

A prefabricated reinforced concrete beam-column connecting structure and a construction method thereof are provided. The prefabricated reinforced concrete beam-column connecting structure includes an upper prefabricated column, a lower prefabricated column, a prefabricated beam, an upper column transfer member, a lower column transfer member, and a connecting slot of beam main reinforcement. The lower column transfer member is sleeved on an upper end portion of the lower prefabricated column. A first horizontal load transfer plate is arranged in the lower column transfer member. An upper end portion of a lower column main reinforcement is anchored at a top of the first horizontal load transfer plate. The upper column transfer member is sleeved on a lower end portion of the upper prefabricated column. A second horizontal load transfer plate is arranged in the upper column transfer member.

8 Claims, 10 Drawing Sheets

(56) References Cited

U.S. PATENT DOCUMENTS 2,724,261 A * 11/1955 Rensaa ..... E04B 1/0007 52/283
3,429,092 A * 2/1969 Hart ..... E04B 1/20 52/236.7
3,733,757 A * 5/1973 Scott ..... E04B 1/215 52/250
4,009,550 A * 3/1977 Young ..... E02D 5/523 405/251
4,060,948 A * 12/1977 Brownlee ..... E04B 1/21 249/19
4,211,045 A * 7/1980 Koizumi ..... E04B 5/43 52/432
4,330,970 A * 5/1982 Bonink ..... E04B 1/215 52/236.7
4,378,664 A * 4/1983 Andaya ..... E04B 1/21 52/745.13
4,865,503 A * 9/1989 Kaimo ..... E04B 1/215 411/513
5,410,847 A * 5/1995 Okawa ..... E04B 1/30 52/272
5,896,721 A * 4/1999 Sugiyama ..... F16B 9/058 52/712
6,679,017 B2 * 1/2004 Woodruff, III ..... E04B 1/215 403/360
7,421,827 B1 * 9/2008 Konstantinidis ..... E04C 5/0604 52/649.3
8,166,717 B2 * 5/2012 Kim ..... E04B 1/30 403/310
8,613,173 B2 * 12/2013 Ander ..... E04B 2/90 52/235
8,800,229 B2 * 8/2014 Rahimzadeh ..... E04B 5/40 52/251
8,898,992 B2 * 12/2014 Rahimzadeh ..... E04B 1/30 52/745.15
9,464,427 B2 * 10/2016 Karns ..... E04H 9/024
9,512,610 B2 * 12/2016 Kinnunen ..... E02D 5/72
9,637,923 B2 * 5/2017 Radhouane ..... E04C 3/293
10,400,438 B2 * 9/2019 Calderon Uriszar-Aldaca ..... E04C 5/165
10,794,053 B2 * 10/2020 Wu ..... E04B 1/41
10,837,173 B2 * 11/2020 Yin ..... E04B 1/04
10,865,557 B2 * 12/2020 Guo ..... E04C 3/26
11,718,990 B2 * 8/2023 Lim ..... E04C 5/162 52/698
11,905,699 B2 * 2/2024 Soivio ..... E04B 1/30
2001/0003234 A1 * 6/2001 Van Doren ..... E04B 1/165 52/250
2002/0189175 A1 * 12/2002 Lancelot, III ..... E04C 5/16 52/378
2009/0308005 A1 * 12/2009 Ireland ..... E04B 1/046 52/250
2010/0071315 A1 * 3/2010 Hong ..... E04B 1/215 52/848
2010/0170194 A1 * 7/2010 Leone ..... E04B 1/215 52/745.21
2010/0322717 A1 * 12/2010 Paul ..... E02D 5/105 405/250
2023/0003024 A1 * 1/2023 Kang ..... E04C 5/165

FOREIGN PATENT DOCUMENTS

CN 110409647 A * 11/2019 ..... E04B 1/20
CN 111255260 A * 6/2020 ..... E04B 1/185
CN 111502000 A * 8/2020 ..... E04B 1/215
CN 115198881 A * 10/2022
ES 2220236 A1 * 12/2004 ..... E04B 5/043
FI 20185498 A1 * 12/2019 ..... E04B 1/48
GB 2315287 A * 1/1998 ..... B28B 23/005
WO WO-9322516 A1 * 11/1993 ..... B21F 27/125

* cited by examiner

PREFABRICATED REINFORCED CONCRETE BEAM-COLUMN CONNECTING STRUCTURE AND CONSTRUCTION METHOD THEREOF

CROSS REFERENCE OF RELATED APPLICATION

The present disclosure claims priority to Chinese Patent Application No. 202211409509.2, titled "PREFABRICATED REINFORCED CONCRETE BEAM-COLUMN CONNECTING STRUCTURE AND CONSTRUCTION METHOD THEREOF", filed on Nov. 10, 2022 with the China National Intellectual Property Administration, which is incorporated herein by reference in its entirety.

FIELD

The present application relates to the field of prefabricated construction, and in particular to a prefabricated reinforced concrete beam-column connecting structure and a construction method thereof.

BACKGROUND

With the development of economy and technology, the advantages of the cast-in-place construction model have gradually disappeared. Compared with the traditional cast-in-place construction model, prefabricated construction have characteristics of high component quality, energy saving and environmental protection, shortened construction period, and saving manpower. Therefore, prefabricated construction has gradually become the key development direction of construction industry in China in the future.

Although the prefabricated construction has many advantages, in actual construction, there are still many technical problems in the beam-column joint. For example, in conventional beam-column joint, it is required to weld steel bars protruding from end portions of prefabricated beams. Multiple steel bars need to be welded, resulting in very slow on-site construction progress. Furthermore, it is difficult to ensure the welding quality due to the long welding length and high welding difficulty as well as a large number of these joints. Therefore, provision of a new type of prefabricated beam-column joint is of extremely important role and significance for the application and development of prefabricated construction.

SUMMARY

The object of the present application is to provide a prefabricated reinforced concrete beam-column connecting structure and a construction method thereof, so as to solve the technical problem of a complex structure and complex construction process of the traditional connecting structure.

In order to realize the above object, the following technical solutions are provided according to the present application.

A prefabricated reinforced concrete beam-column connecting structure includes an upper prefabricated column, a lower prefabricated column, and a prefabricated beam, where the upper prefabricated column comprises an upper column main reinforcement, an upper column stirrup and upper column concrete, the lower prefabricated column comprises a lower column main reinforcement, a lower column stirrup and lower column concrete, and the prefabricated beam comprises a beam upper main reinforcement, a beam lower main reinforcement, a beam stirrup, and a beam concrete, the prefabricated reinforced concrete beam-column connecting structure further comprises an upper column transfer member, a lower column transfer member and a connecting slot of beam main reinforcement, where an upper end portion of the lower column main reinforcement extends beyond a top surface of the lower column concrete, and a part, extending beyond the lower column concrete, of the lower column main reinforcement is provided with a thread, a shape of a horizontal section of the lower column transfer member is adapted to a shape of a horizontal section the lower prefabricated column, and a lower end portion of the lower column transfer member is sleeved on an upper end portion of the lower prefabricated column, first horizontal load transfer plates are arranged at intervals in a vertical direction inside the lower column transfer member, first perforations are formed at positions, corresponding to the lower column main reinforcement, on surfaces of the first horizontal load transfer plates, an upper end portion of the lower column main reinforcement passes through the first perforations in sequence and is anchored at a top of an uppermost one of the first horizontal load transfer plates by a first nut, and first grouting holes are formed at a middle of the surfaces of the first horizontal load transfer plates, a lower end portion of the upper column main reinforcement extends beyond a bottom surface of the upper column concrete, and a part, extending beyond the upper column concrete, of the upper column main reinforcement is provided with a thread, where a shape of a horizontal section of the upper column transfer member is adapted to a shape of a horizontal section of the upper prefabricated column, and an upper end portion of the upper column transfer member is sleeved on a lower end portion of the upper prefabricated column, where second horizontal load transfer plates are arranged at intervals in a vertical direction inside the upper column transfer member, second perforations are formed at positions, corresponding to the upper column main reinforcement, on surfaces of the second horizontal load transfer plates, a lower end portion of the upper column main reinforcement passes through the second perforations in sequence and is anchored at a bottom of a lowermost one of the second horizontal load transfer plates by a second nut, and second grouting holes are formed at a middle of the surfaces of the second horizontal load transfer plates, the upper column transfer member is arranged on a top of the lower column transfer member and is connected with the lower column transfer member by welding, a grouting pipe is pre-embedded in the upper column concrete, and a lower end portion of the grouting pipe passes through the first grouting holes in sequence and extends into a joint between the upper prefabricated column and the lower prefabricated column, where a joint concrete is poured into a cavity enclosed by the lower column transfer member, the upper column transfer member, the lower prefabricated column, and the upper prefabricated column, where the connecting slot of beam main reinforcement is connected to one side of the upper column transfer member and the lower column transfer member, the prefabricated beam is arranged on one side of a joint between the upper prefabricated column and the lower prefabricated column and at a position close to the connecting slot of beam main reinforcement, and an end portion of one side, close to the connecting slot of beam main reinforcement, of the beam upper main reinforcement and an end portion of one side, close to the connecting slot of beam main reinforcement, of the beam lower main reinforcement both extend beyond end portion faces of corresponding sides of the beam concrete, the end portion of one side of the beam upper main reinforcement close to the connecting slot of beam main reinforcement is bent downward and extends into the connecting slot of beam main reinforcement, the end portion of one side of the beam lower main reinforcement close to the connecting slot of beam main reinforcement is bent upward and extend into the connecting slot of beam main reinforcement, shear bolts are provided at intervals on an outer surface of the connecting slot of beam main reinforcement, and a joint post-casted concrete is poured between the prefabricated beam and the lower column transfer member and between the prefabricated beam and the upper column transfer member.

In an embodiment, a first anchoring plate is provided between the first nut and the top of the uppermost one of the first horizontal load transfer plates, and a second anchoring plate is provided between the second nut and the top of the lowermost one of the second horizontal load transfer plates.

In an embodiment, the lower column transfer member is cylindrical, a triangular groove is formed at an upper end portion of an outer surface of the lower column transfer member along a top edge of the lower column transfer member, and the lower column transfer member has a height equal to h/2+b, where h is a height of the prefabricated beam, and b ranges from 20 mm to 500 mm.

In an embodiment, the upper column transfer member is cylindrical, a triangular groove is formed at a lower end portion of an outer surface of the upper column transfer member along a bottom edge of the upper column transfer member, and the upper column transfer member has a height equal to h/2+b, where h is the height of the prefabricated beam, and b ranges from 20 mm to 500 mm.

In an embodiment, the number of the connecting slot of beam main reinforcement is one, and the connecting slot of beam main reinforcement comprises a first bottom plate and a first side plate, where a horizontal section of the first side plate is in a horizontal-laying U shape, and an opening of the U shape of the first side plate faces towards one side of the lower column transfer member and the upper column transfer member, where an upper portion of the first side plate is connected to the upper column transfer member, a lower portion of the first side plate is connected to the lower column transfer member, a first arc-shaped gap is formed in a middle of a vertical edge, connected to the lower column transfer member and the upper column transfer member, of the first side plate, and a welded seam between the lower column transfer member and the upper column transfer member passes through the first arc-shaped gap, where the first bottom plate is configured to block a rectangular opening enclosed by a bottom edge of the first side plate and the lower column transfer member, first through holes are formed at intervals on the first bottom plate, and a bent section of the beam lower main reinforcement extends into the connecting slot of beam main reinforcement through the first through holes.

In an embodiment, a transverse baffle is provided inside a cavity enclosed by the first side plate, the lower column transfer member, and the upper column transfer member, one end portion, close to the lower column transfer member and the upper column transfer member, of the transverse baffle is connected to the lower column transfer member and the upper column transfer member, and one end portion of the transverse baffle away from the lower column transfer member and the upper column transfer member extends beyond the first side plate, where the first side plate comprises a front side plate section and a rear side plate section, a second arc-shaped gap is formed at a position, corresponding to the first arc-shaped gap, on one side of the transverse baffle close to the lower column transfer member and the upper column transfer member, a welded seam between the lower column transfer member and the upper column transfer member passes through the first arc-shaped gap, a horizontal section of the front side plate section and a horizontal section of the rear side plate section each is in a horizontal-laying L shape, and the front side plate section and the rear side plate section are symmetrically arranged on two opposite sides of the transverse baffle, where one end portion of the front first side plate is connected to the lower column transfer member and the upper column transfer member, one end portion of the front side plate section is connected to a front side surface of the transverse baffle one end portion of the rear first side plate is connected to the lower column transfer member and the upper column transfer member, the other end portion of the rear side plate section is connected to a rear side surface of the transverse baffle, and the shear bolts are connected to a part of the transverse baffle extending beyond the first side plate at intervals.

In an embodiment, the number of the connecting slot of beam main reinforcement is two, which are a upper connecting slot of beam main reinforcement and a lower connecting slot of beam main reinforcement, the lower connecting slot of beam main reinforcement is connected to the lower column transfer member and comprises a second side plate and a second bottom plate, where a horizontal section of the second side plate is in a horizontal-laying U shape, and an opening of the U shape of the second side plate faces towards one side of the lower column transfer member, where the second bottom plate is arranged to block a rectangular opening formed by a bottom edge of the second side plate and the lower column transfer member, second through holes are formed at intervals on the second bottom plate, a bent section of the beam lower main reinforcement extends into the lower connecting slot of beam main reinforcement through the second through holes, where the upper connecting slot of beam main reinforcement is connected to the upper column transfer member and comprises a third side plate and a top plate, a horizontal section of the third side plate is in a horizontal-laying U shape, and an opening of the U shape of the third side plate faces towards one side of the upper column transfer member, where the top plate is arranged to block a rectangular opening enclosed by a top edge of the third side plate and the upper column transfer member, third through holes are formed at intervals on the top plate, and a bent section of the beam upper main reinforcement extends into the upper connecting slot of beam main reinforcement **6*a*** through the third through holes.

A construction method for a prefabricated reinforced concrete beam-column connecting structure includes the following steps:

step 1: fabricating the lower prefabricated column, the upper prefabricated column and the prefabricated beam, where, during fabricating of the lower prefabricated column, the lower column transfer member is sleeved on the top of the lower prefabricated column, and the upper end portion of the lower column main reinforcement passes through the first perforations in sequence and is anchored at the top of the uppermost one of the first horizontal load transfer plates, where, during fabricating the upper prefabricated column, the upper column transfer member is sleeved on the bottom of the upper prefabricated column, and the lower end portion of the upper column main reinforcement passes through the second perforations in sequence and is anchored at the bottom of the lowermost one of the second horizontal load transfer plate, where, during fabricating of the prefabricated beam, the end portion of the beam upper main reinforcement is extended beyond the end surface of the beam concrete, and an exceeding part of the beam upper main reinforcement is bent downward, where the end portion of the beam lower main reinforcement is extended beyond the end surface of the beam concrete, and an exceeding part of the beam lower main reinforcement is bent upward;

step 2: installing the lower prefabricated column in place;

step 3: hoisting the upper prefabricated column and aligning a center of the bottom surface of the upper prefabricated column with a center of the top surface of the lower prefabricated column;

step 4: determining that the upper prefabricated column is positioned correctly, then butt welding at a joint seam between the upper column transfer member and the lower column transfer member;

step 5: pouring the joint concrete from the upper end portion of the grouting pipe into a cavity enclosed by the upper column transfer member and the lower column transfer member;

step 6: connecting the connecting slot of beam main reinforcement at a joint, corresponding to the prefabricated beam, on the upper column transfer member and the lower column transfer member by welding;

step 7: hoisting the prefabricated beam, and extending the bent section of the beam lower main reinforcement and the bent section of the beam upper main reinforcement into the connecting slot of beam main reinforcement; and step 8: pouring the joint post-casted concrete into a formwork, and the construction is completed.

Compared with the conventional technology, the present application has the following characteristics and advantageous effects.

1. In the present application, the upper column transfer member is provided at the bottom of the upper prefabricated column, the lower column transfer member is provided on the top of the lower prefabricated column, and the joint between the upper column transfer member and the lower column transfer member is welded, so that the upper prefabricated column and the lower prefabricated column can be jointed to each other more stably. In addition, in the present application, a reliable and convenient connection between the beam and the column can be achieved with the provision of the connecting slot of beam main reinforcement, thereby ensuring the stability and safety of the joint.
2. In the present application, the end portions of the longitudinal steel bars of the prefabricated beam in the present application can be bent in advance and then enters into the connecting slot of beam main reinforcement without being fixed by welding, which can greatly reduce the welding workload and welding difficulty, and thus significantly shorten the construction period.
3. An appropriate structural form of the connecting slot of beam main reinforcement according to the present application can be selected according to the internal forces applied to the beam steel bars or the beam or the requirements for construction quality. In a case of a small diameter of a pre-main reinforcement or a small internal force applied to a pre-main reinforcement, the connecting slot of beam main reinforcement in the first embodiment is preferable. In a case of a large diameter of the pre-main reinforcement or a large internal force applied to the pre-main reinforcement, in order to prevent the middle of the connecting slot of beam main reinforcement from deforming, the connecting slot of beam main reinforcement in the second embodiment is preferable. In a case that on-site welding requirements are high, welding conditions are poor, and welding quality is difficult to be ensured, the connecting slot of beam main reinforcement in the third embodiment is preferable. The present application can meet most of construction conditions, which has good universality and versatility.

BRIEF DESCRIPTION OF THE DRAWINGS

The present application will be further described in detail below in combination with the accompanying drawings.

Figure 1:
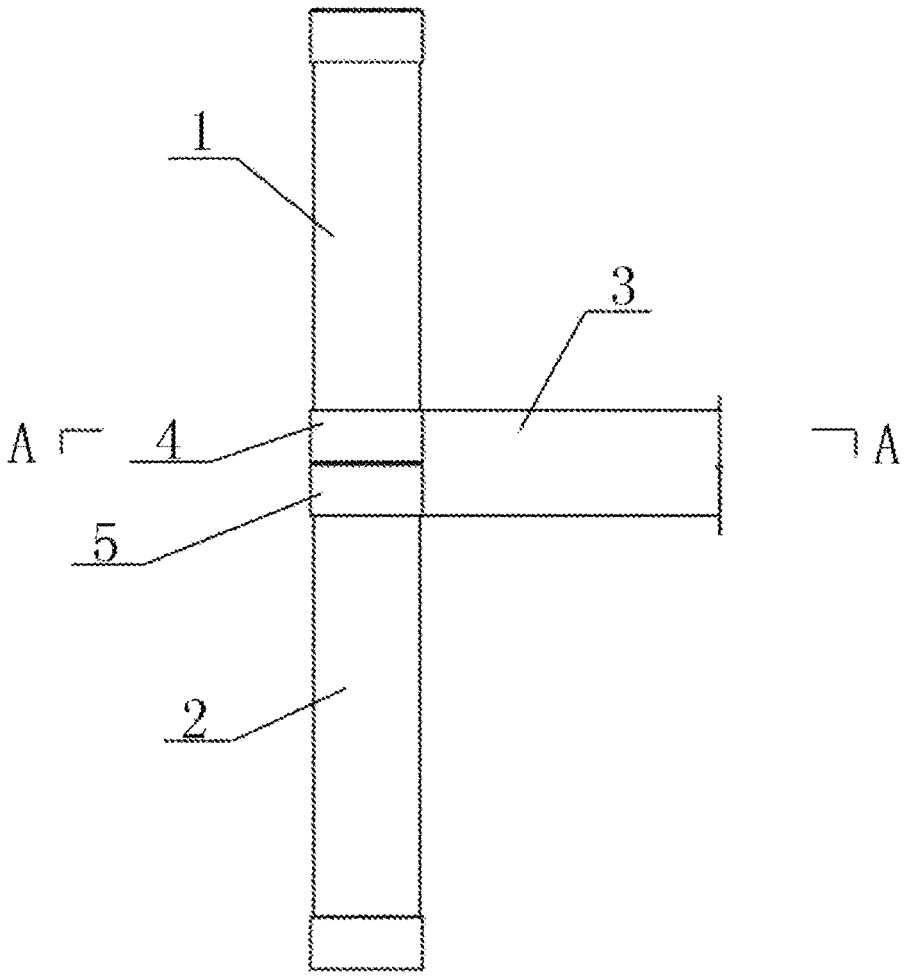
FIG. 1 is a schematic view of a prefabricated reinforced concrete beam-column connecting structure according to the present application.

| Reference numerals are as follows: | |
|---|---|
| 1 - upper prefabricated column | 1.1 - upper column main reinforcement, |
| 1.2 - upper column stirrup | 1.3 - upper column concrete, |
| 2 - lower prefabricated column | 2.1 - lower column main reinforcement, |
| 2.2 - lower column stirrup | 2.3 - lower column concrete, |
| 3 - prefabricated beam | 3.1 - beam upper main reinforcement, |
| 3.2 - beam lower main reinforcement | 3.3 - beam stirrup, |
| 3.4 - beam concrete | 4 - upper column transfer member, |
| 5 - lower column transfer member | 6 - connecting slot of beam main reinforcement, |
| 6.1 - first bottom plate | 6.2 - first side plate, |
| 6.2.1 - front side plate section | 6.2.2 - rear side plate section, |
| 6.3 - transverse baffle | 6a - upperconnecting slot of beam main reinforcement, |
| 6a.1 - third side plate | 6a.2 - top plate, |
| 6b - lower connecting slot of beam main reinforcement | |
| 6b.1 - second side plate, | |
| 6b.2 - second bottom plate | 7 - first horizontal load transfer plate, |
| 8 - first perforation | 9 - first grouting hole, |
| 10 - second horizontal load transfer plate | 11 - second perforation, |
| 12 - second grouting hole | 13 - first nut, |
| 14 - second nut | 15 - grouting pipe, |
| 16 - joint concrete | 17 - shear bolt, |
| 18 - joint post - casted concrete | 19 - first anchoring plate, |
| 20 - second anchoring plate | 21 - first arc - shaped gap, |
| 22 - first through hole | 23 - second arc - shaped gap, |
| 24 - second through hole | 25 - third through hole. |

DETAILED DESCRIPTION OF THE EMBODIMENTS

Figure 2:
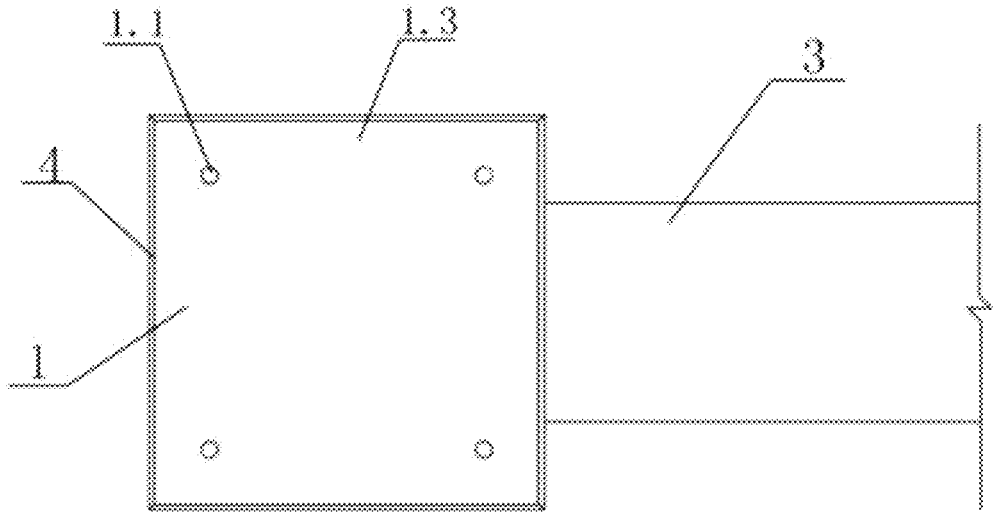
FIG. 2 is a schematic cross-sectional structural view taken along line A-A in FIG. 1.
Figure 3:
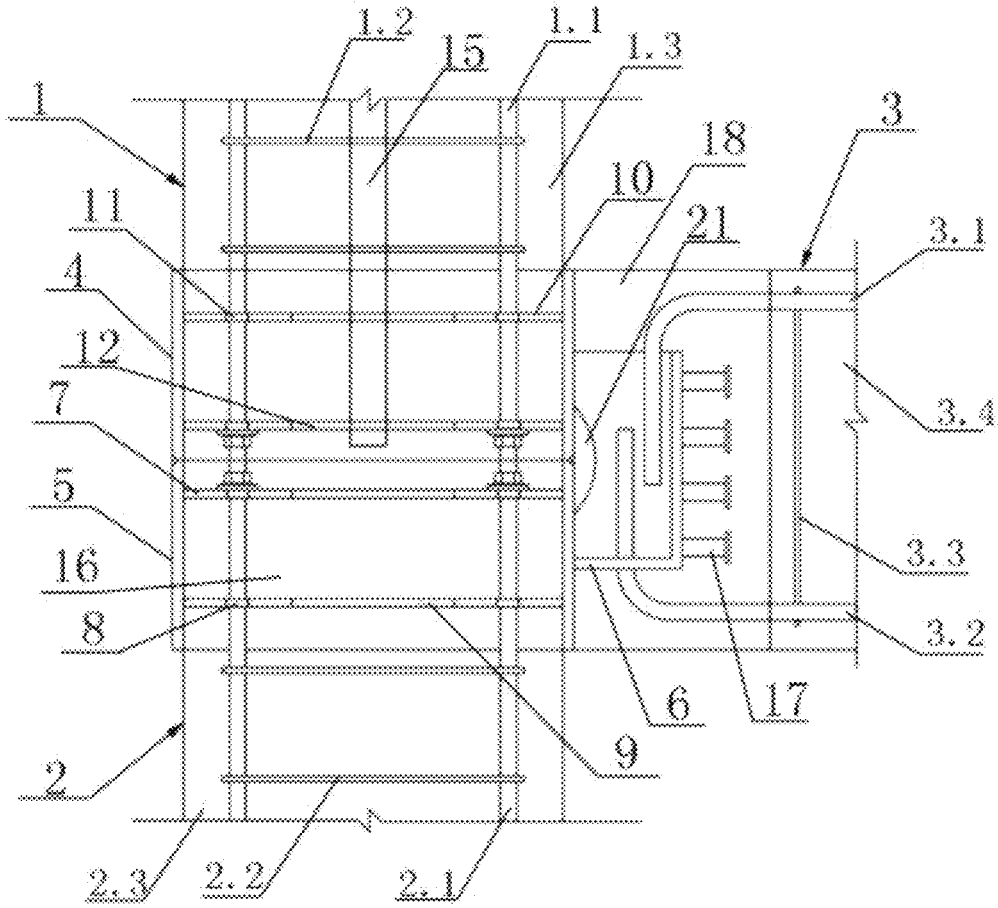
FIG. 3 is a schematic vertical cross-sectional structural view of the beam-column connecting structure according to the present application when a connecting slot of a beam main reinforcement is a connecting slot of the beam main reinforcement described in a first embodiment.
Figure 4:
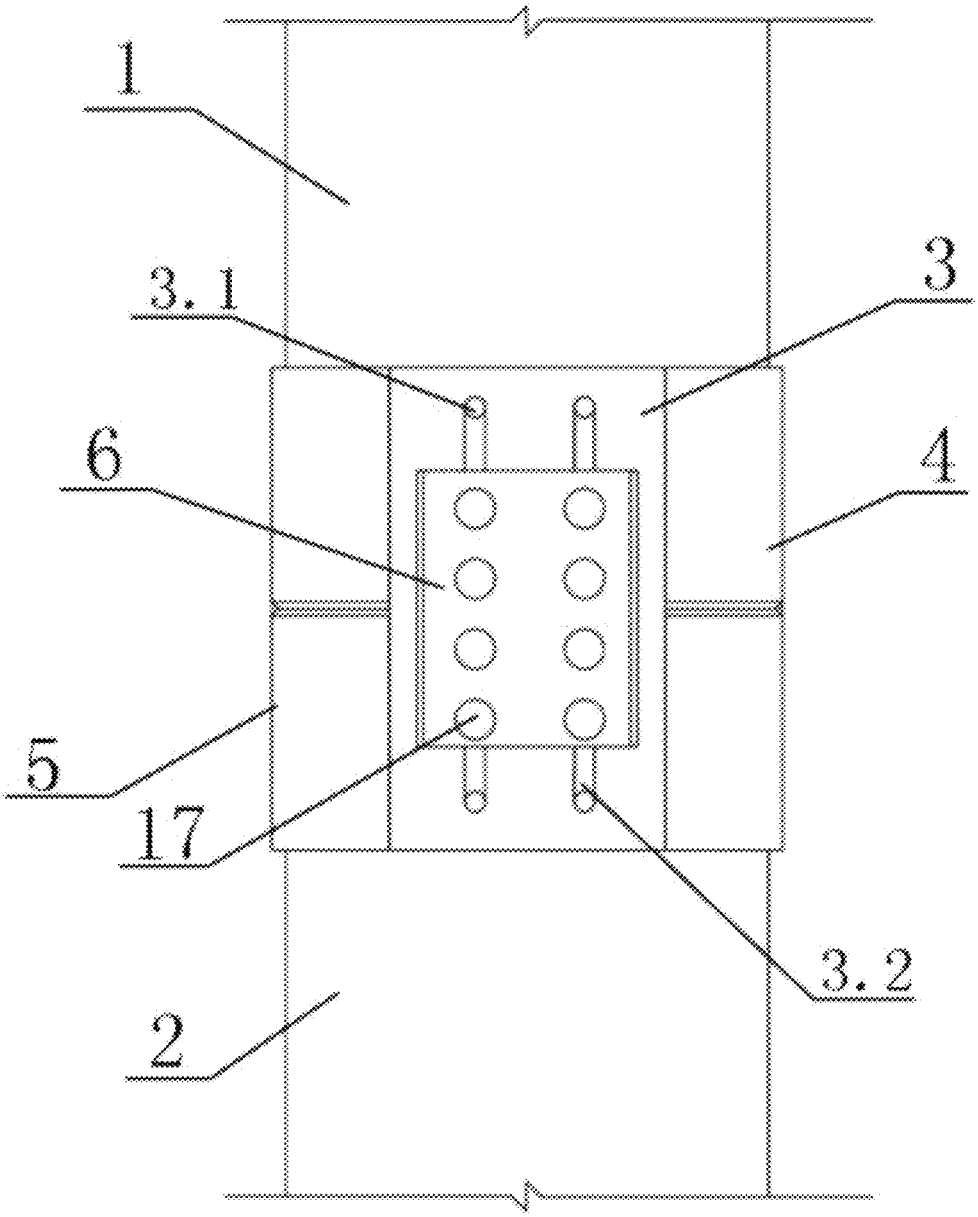
FIG. 4 is a schematic structural view of the connecting slot of the beam main reinforcement according to the first embodiment of the present application when being connected to a side of an upper column transfer member and a lower column transfer member.
Figure 5:
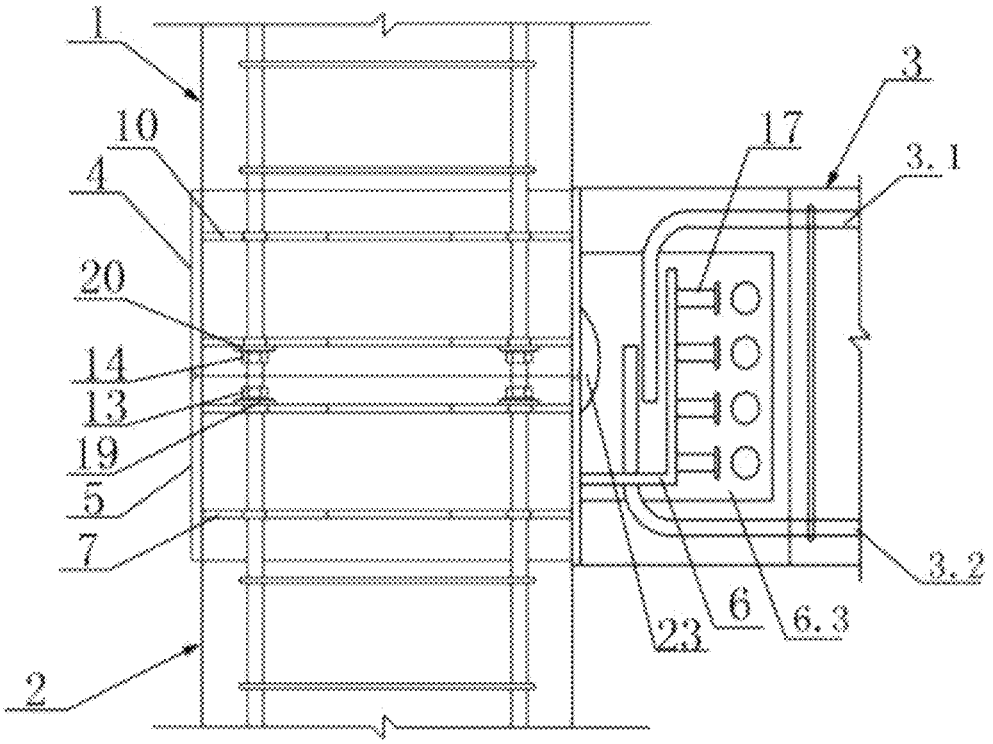
FIG. 5 is a schematic vertical cross-sectional structural view of the beam-column connecting structure according to the present application when the connecting slot of the beam main reinforcement is a connecting slot of a beam main reinforcement described in a second embodiment.
Figure 6:
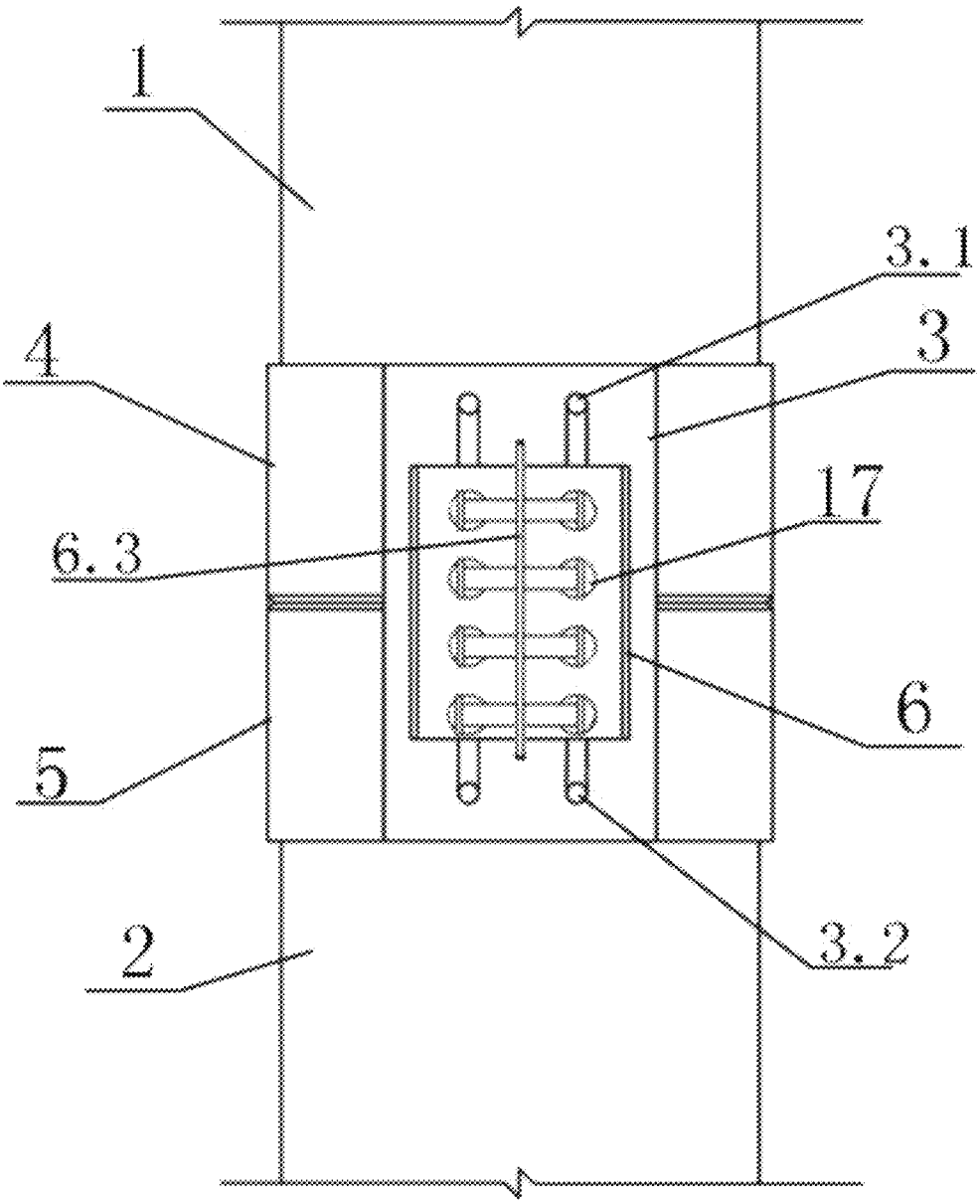
FIG. 6 is a schematic structural view of the connecting slot of beam main reinforcement according to the second embodiment of the present application when being connected to the side of the upper column transfer member and the lower column transfer member.
Figure 7:
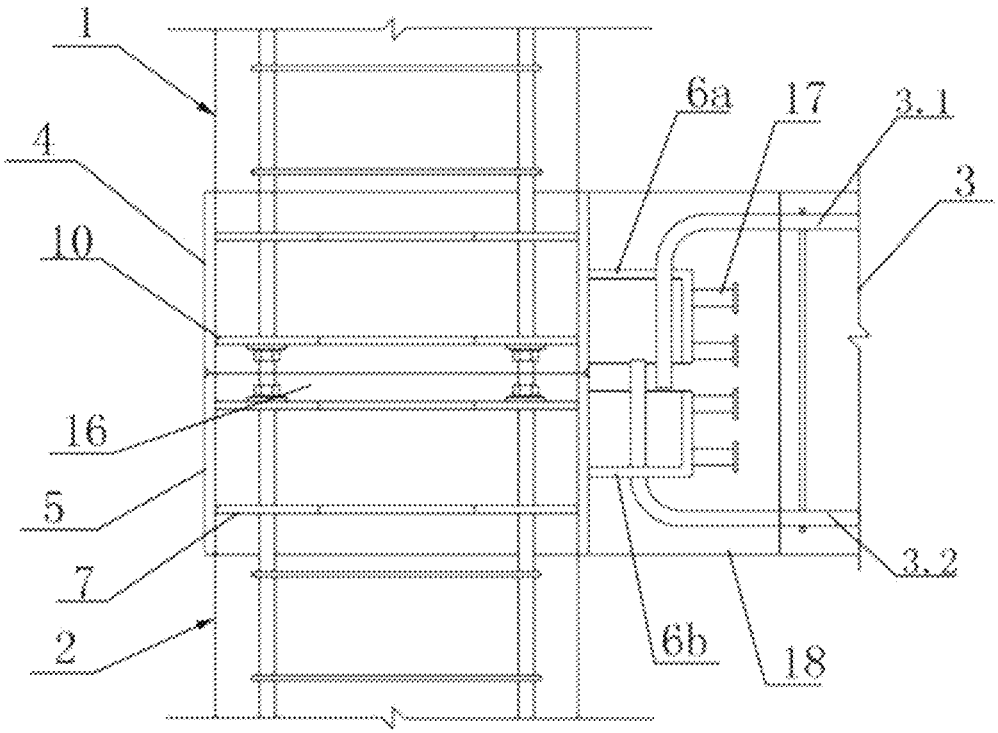
FIG. 7 is a schematic vertical cross-sectional structural view of the beam-column connecting structure according to the present application when the connecting slot of beam main reinforcement is a connecting slot of a beam main reinforcement described in a third embodiment.
Figure 8:
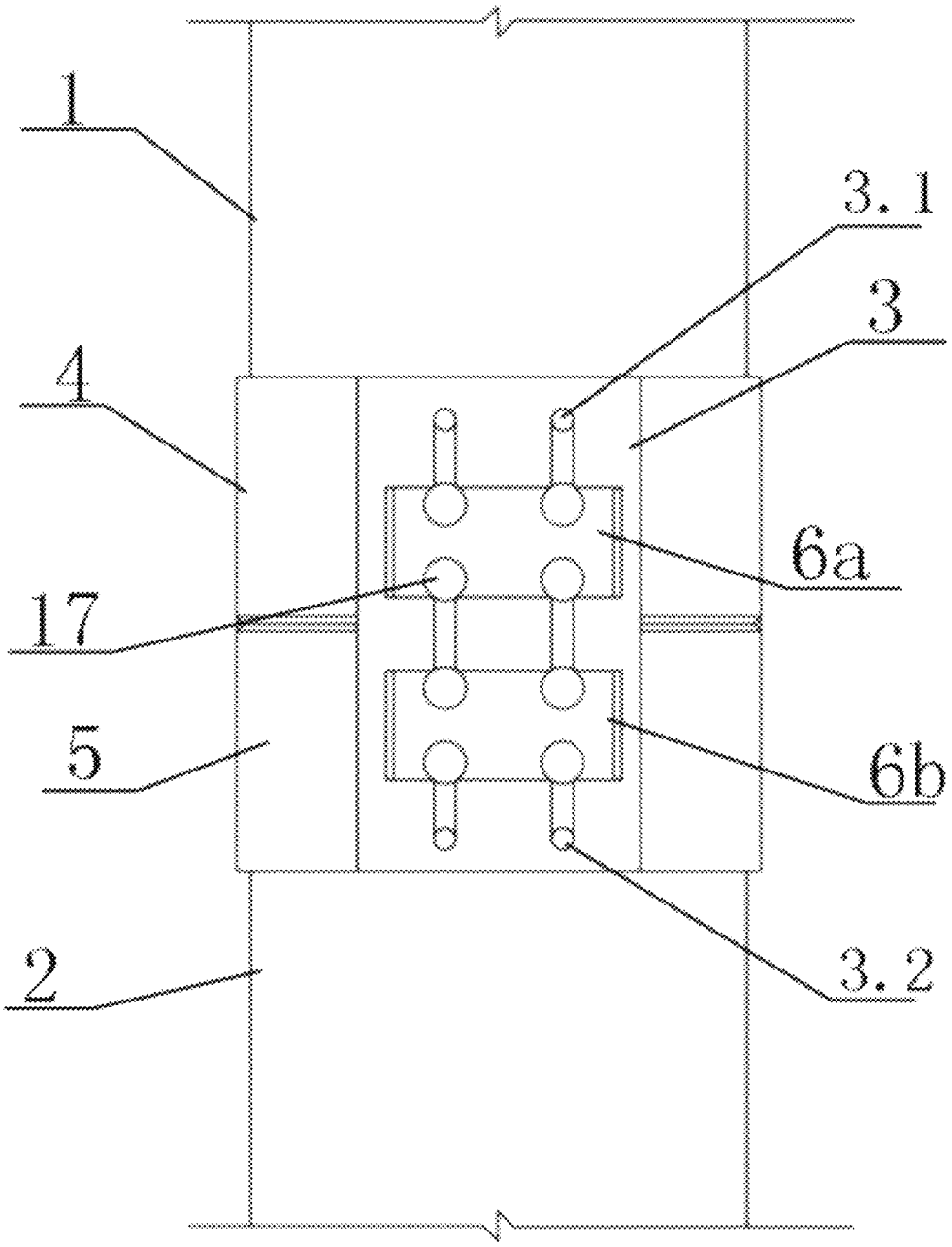
FIG. 8 is a schematic structural view of the connecting slot of beam main reinforcement according to the third embodiment of the present application when being connected to the side of the upper column transfer member and the lower column transfer member.
Figure 9:
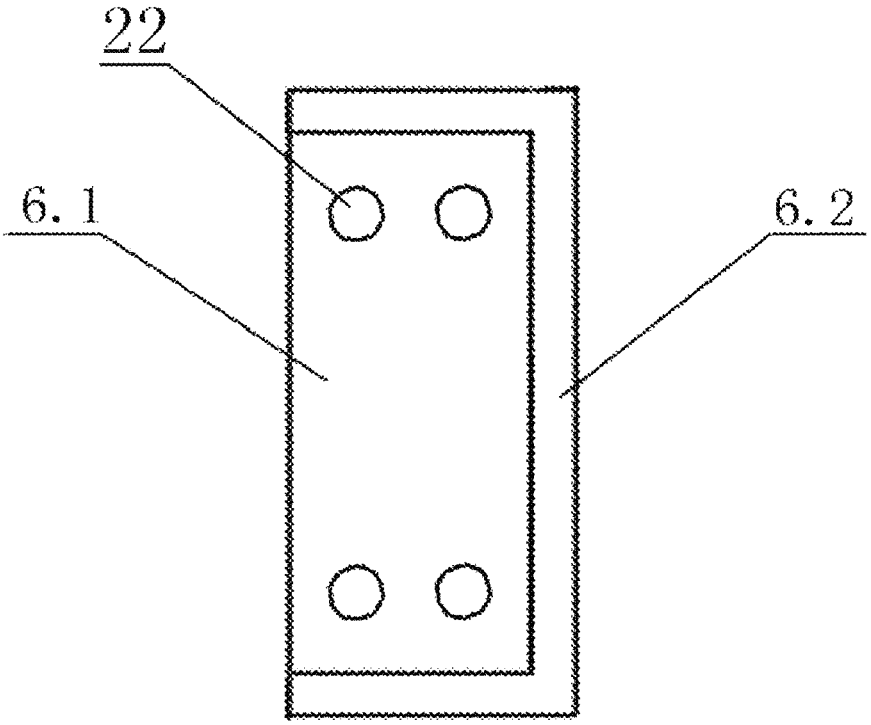
FIG. 9 is a top view of the connecting slot of beam main reinforcement according to the first embodiment of the present application.
Figure 10:
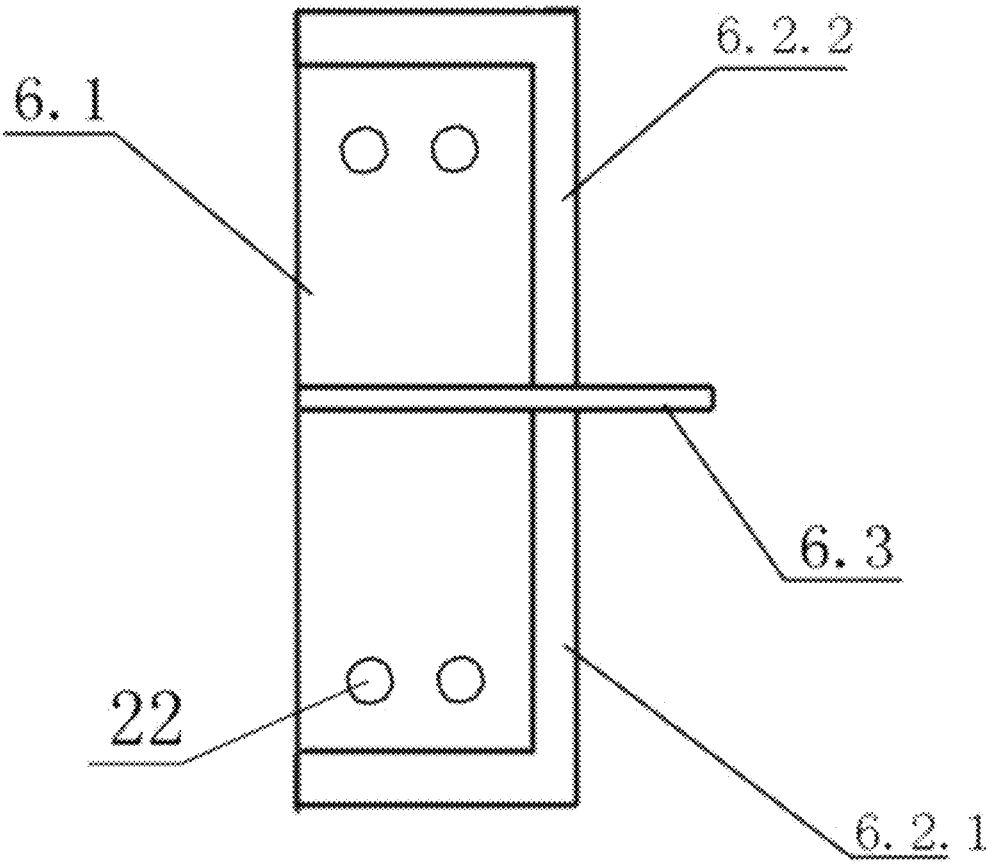
FIG. 10 is a bottom view of the connecting slot of beam main reinforcement according to the second embodiment of the present application.
Figure 11:
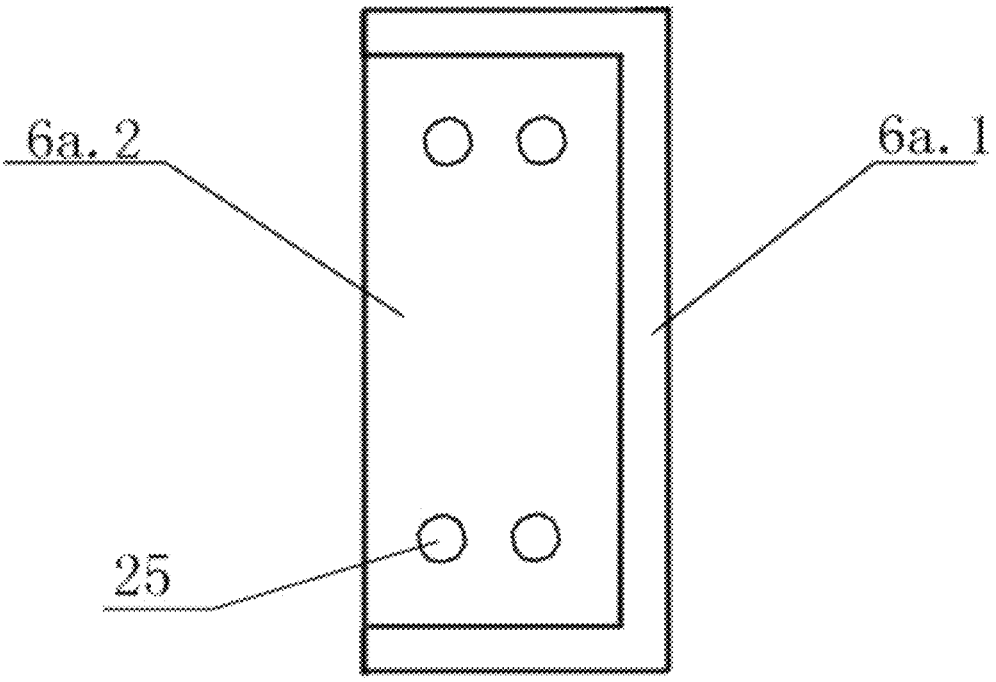
FIG. 11 is a top view of a upper connecting slot of the beam main reinforcement on the beam according to the third embodiment of the present application.
Figure 12:
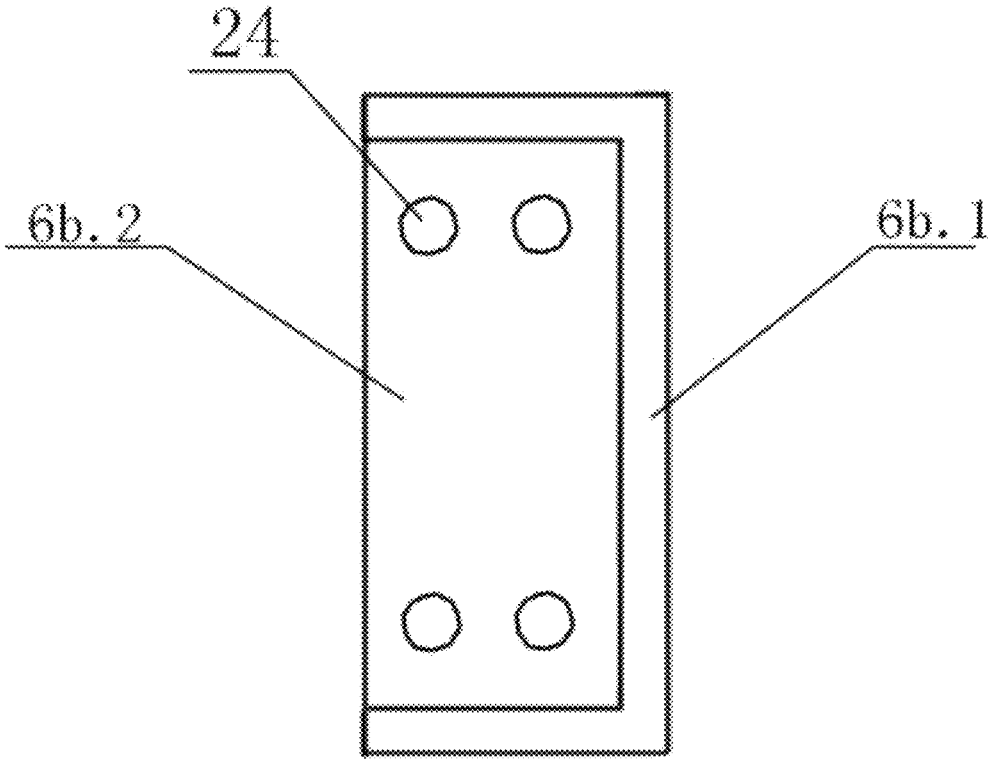
FIG. 12 is a top view of a lower connecting slot of the beam main reinforcement according to the third embodiment of the present application.

As shown in FIGS. 1 to 12, a prefabricated reinforced concrete beam-column connecting structure includes an upper prefabricated column 1, a lower prefabricated column 2 and a prefabricated beam 3. The upper prefabricated column 1 includes an upper column main reinforcement 1.1, an upper column stirrup 1.2 and upper column concrete 1.3. The upper column stirrup 1.2 is configured to constitute an upper section column steel frame along with the upper column main reinforcement 1.1. The lower prefabricated column 2 includes a lower column main reinforcement 2.1, a lower column stirrup 2.2 and lower column concrete 2.3. The lower column stirrup 2.2 is configured to constitute a lower section column steel frame. The prefabricated beam 3 includes a beam upper main reinforcement 3.1, a beam lower main reinforcement 3.2, a beam stirrup 3.3, and beam concrete 3.4. The prefabricated reinforced concrete beam-column connecting structure further includes an upper column transfer member 4, a lower column transfer member 5 and a connecting slot of beam main reinforcement 6. An upper end portion of the lower column main reinforcement 2.1 extends beyond a top surface of the lower column concrete 2.3. A part, extending beyond the lower column concrete 2.3, of the lower column main reinforcement 2.1 is provided with threads. A horizontal section shape of the lower column transfer member 5 is adapted to a horizontal section shape of the lower prefabricated column 2, and a lower end portion of the lower column transfer member 5 is sleeved on an upper end portion of the lower prefabricated column 2. First horizontal load transfer plates 7 are arranged at intervals in a vertical direction inside the lower column transfer member 5. First perforations 8 are formed at positions, corresponding to the lower column main reinforcement 2.1, on surfaces of the first horizontal load transfer plates 7. An upper end portion of the lower column main reinforcement 2.1 passes through the first perforations 8 in sequence, and is anchored at a top of an uppermost first horizontal load transfer plate 7 by a first nut 13. A first grouting hole 9 is formed at a middle portion of the surface of the first horizontal load transfer plate 7.

A lower end portion of the upper column main reinforcement 1.1 extends beyond a bottom surface of the upper column concrete 1.3. A part, extending beyond the upper column concrete 1.3, of the upper column main reinforcement 1.1 is provided with threads. A horizontal section shape of the upper column transfer member 4 is adapted to a horizontal section shape of the upper prefabricated column 1, and an upper end portion of the upper column transfer member 4 is sleeved on a lower end portion of the upper prefabricated column 1. Second horizontal load transfer plates 10 are arranged at intervals in a vertical direction inside the upper column transfer member 4. Second perforations 11 are formed at positions, corresponding to the upper column main reinforcement 1.1, on surfaces of the second horizontal load transfer plates 10. A lower end portion of the upper column main reinforcement 1.1 passes through the second perforations 11 in sequence, and is anchored at a bottom of a lowermost second horizontal load transfer plate 10 by a second nut 14. A second grouting hole 12 is formed at a middle portion of the surface of the second horizontal load transfer plate 10. The upper column transfer member 4 is provided on a top of the lower column transfer member 5, and is connected with the lower column transfer member 5 by welding. A grouting pipe 15 is pre-embedded in the upper column concrete 1.3, and a lower end portion of the grouting pipe 15 passes through the first grouting holes 9 in sequence and extends into a joint between the upper prefabricated column 1 and the lower prefabricated column 2. A joint concrete 16 is poured into a cavity enclosed by the lower column transfer member 5, the upper column transfer member 4, the lower prefabricated column 2, and the upper prefabricated column 1. The connecting slot of beam main reinforcement 6 is connected to one side of the upper column transfer member 4 and the lower column transfer member 5. The prefabricated beam 3 is provided on one side of a joint between the upper prefabricated column 1 and the lower prefabricated column 2 and is close to the connecting slot of beam main reinforcement 6. An end portion of one side, close to the connecting slot of beam main reinforcement 6, of the beam upper main reinforcement 3.1 and an end portion of one side, close to the connecting slot of beam main reinforcement 6, of the beam lower main reinforcement 3.2 both extend beyond the end portion face of a corresponding side of the beam concrete 3.4. The end portion of one side of the beam upper main reinforcement 3.1 close to the connecting slot of beam main reinforcement 6 is bent downward and extends into the connecting slot of beam main reinforcement 6. The end portion of one side of the beam lower main reinforcement 3.2 close to the connecting slot of beam main reinforcement 6 is bent upward and extends into the connecting slot of beam main reinforcement 6. Shear bolts 17 are arranged at intervals on an outer surface of the connecting slot of beam main reinforcement 6. A joint post-casted concrete 18 is poured between the prefabricated beam 3 and the lower column transfer member 5 and between the prefabricated beam 3 and the upper column transfer member 4.

In an embodiment, the horizontal sections of the upper prefabricated column 1 and the lower prefabricated column 2 are both rectangular, the upper column transfer member 4 is constituted by four rectangular steel plates being spliced end to end, and the lower column transfer member 5 is constituted by four rectangular steel plates being spliced end portion to end.

In an embodiment, the outer diameter of the grouting pipe 15 is less than the diameter of the first grouting hole 9, and a gap is provided between an outer wall of the grouting pipe 15 and a side wall of the first grouting hole 9.

In an embodiment, a first anchoring plate 19 is provided between the first nut 13 and the top of the uppermost first horizontal load transfer plate 7, and a second anchoring plate 20 is provided between the second nut 14 and the top of the lowermost second horizontal load transfer plate 10.

In an embodiment, the lower column transfer member 5 is cylindrical, a triangular groove is provided at an upper end portion of an outer surface of the lower column transfer member 5 along a top edge thereof, and the lower column transfer member 5 has a height equal to h/2+b, where h represents a height of the prefabricated beam 3, and the value of b ranges from 20 mm to 500 mm.

In an embodiment, the upper column transfer member 4 is cylindrical, a triangular groove is provided at a lower end portion of an outer surface of the upper column transfer member 4 along a bottom edge thereof, and the upper column transfer member 4 has a height equal to h/2+b, where h represents the height of the prefabricated beam 3, and the value of b ranges from 20 mm to 500 mm.

In a first embodiment, in a case of both the beam upper main reinforcement 3.1 and the beam lower main reinforcement 3.2 have relative small diameters or an internal force applied to the beam upper main reinforcement 3.1 and the beam lower main reinforcement 3.2 is relative small, the number of the connecting slot of beam main reinforcement 6 is one. The connecting slot of beam main reinforcement 6 includes a first bottom plate 6.1 and a first side plate 6.2. A horizontal section of the first side plate 6.2 is in a horizontal-laying U shape, and an opening of the U shape of the first side plate 6.2 faces towards one side of the lower column transfer member 5 and the upper column transfer member 4. Herein, the wording "horizontal-laying U shape" refers to two legs of a U-shape member are arranged horizontal, and located at the same horizontal plane, that is, the orthographic projection of the horizontal-laying U-shape member on the horizontal plane is in shape of U. An upper portion of the first side plate 6.2 is connected to the upper column transfer member 4, and a lower portion of the first side plate 6.2 is connected to the lower column transfer member 5. A first arc-shaped gap 21 is formed in the middle of a vertical edge, connected to the lower column transfer member 5 and the upper column transfer member 4, of the first side plate 6.2. A welded seam between the lower column transfer member 5 and the upper column transfer member 4 passes through the first arc-shaped gap 21. The first bottom plate 6.1 is arranged to block a rectangular opening enclosed by a bottom edge of the first side plate 6.2 and the lower column transfer member 5. First through holes 22 are formed at intervals on the first bottom plate 6.1. A bent section of the beam lower main reinforcement 3.2 extends into the connecting slot of beam main reinforcement 6 through the first through holes 22.

In a second embodiment, in a case of both the beam upper main reinforcement 3.1 and the beam lower main reinforcement 3.2 have relative large diameters or an internal force applied to the beam upper main reinforcement 3.1 and the beam lower main reinforcement 3.2 is relative large, in order to prevent the middle of the connecting slot of beam main reinforcement 6 from being deformed, a transverse baffle 6.3 is provided inside a cavity enclosed by the first side plate 6.2, the lower column transfer member 5, and the upper column transfer member 4. One end portion, close to the lower column transfer member 5 and the upper column transfer member 4, of the transverse baffle 6.3 is connected to the lower column transfer member 5 and the upper column transfer member 4. One end portion of the transverse baffle 6.3 away from the lower column transfer member 5 and the upper column transfer member 4 extends beyond the first side plate 6.2. The first side plate 6.2 includes a front side plate section 6.2.1 and a rear side plate section 6.2.2. A second arc-shaped gap 23 is formed at a position corresponding to the first arc-shaped gap 21 on one side of the transverse baffle 6.3 close to the transfer members. A welded seam between the lower column transfer member 5 and the upper column transfer member 4 passes through the first arc-shaped gap 21. A horizontal section of the front side plate section 6.2.1 and a horizontal section of the rear side plate section 6.2.2 each is in a horizontal-laying L shape. Herein, the wording "horizontal-laying L shape" refers to two branches of a L-shape member are arranged horizontal, and located at the same horizontal plane, that is, the orthographic projection of the horizontal-laying L-shape member on the horizontal plane is in shape of L. In addition, the front side plate section 6.2.1 and the rear side plate section 6.2.2 are symmetrically arranged on two opposite sides of the transverse baffle 6.3. One end portion of the front first side plate 6.2 is connected to the lower column transfer member 5 and the upper column transfer member 4, and the other end portion of the front side plate section 6.2.1 is connected to a front side surface of the transverse baffle 6.3. One end portion of the rear first side plate 6.2 is connected to the lower column transfer member 5 and the upper column transfer member 4, and the other end portion of the rear side plate section 6.2.2 is connected to a rear side surface of the transverse baffle 6.3. The shear bolts 17 are connected at intervals on a part of the transverse baffle 6.3 extending beyond the first side plate 6.2. In the embodiment, the transverse baffle 6.3 has a height greater than that of the first side plate 6.2.

In a third embodiment, in a case that on-site welding requirements are high, welding conditions are poor, and welding quality is difficult to be ensured, the number of the connecting slot of beam main reinforcement 6 can be two, which are a upper connecting slot of beam main reinforcement 6*a* and a lower connecting slot of beam main reinforcement 6*b*. The lower connecting slot of beam main reinforcement 6*b* is connected to the lower column transfer member 5 and includes a second side plate 6*b*.1 and a second bottom plate 6*b*.2. A horizontal section of the second side plate 6*b*.1 is in a horizontal-laying U shape, and an opening of the U shape of the second side plate 6*b*.1 faces towards one side of the lower column transfer member 5. The second bottom plate 6*b*.2 is arranged to block a rectangular opening formed by a bottom edge of the second side plate 6*b*.1 and the lower column transfer member 5. Second through holes 24 are formed at intervals on the second bottom plate 6*b*.2. A bent section of the beam lower main reinforcement 3.2 extends into the lower connecting slot of beam main reinforcement 6*b* through the second through holes 24. The upper connecting slot of beam main reinforcement 6*a* is connected to the upper column transfer member 4 and includes a third side plate 6*a*.1 and a top plate 6*a*.2. A horizontal section of the third side plate 6*a*.1 is in a horizontal-laying U shape, and an opening of the U shape of the third side plate 6*a*.1 faces towards one side of the upper column transfer member 4. The top plate 6*a*.2 is arranged to block a rectangular opening enclosed by a top edge of the third side plate 6*a*.1 and the upper column transfer member 4. Third through holes 25 are formed at intervals on the top plate 6*a*.2. A bent section of the beam upper main reinforcement 3.1 extends into the upper connecting slot of beam main reinforcement 6*a* through the third through holes 25.

In the embodiment, the first horizontal load transfer plate 7 is a rectangular steel plate that is welded inside the lower column transfer member 11. The number of the first horizontal load transfer plate 7 is two, and these two first horizontal load transfer plates 7 are welded in the inner cavity of the lower column transfer member 11 in parallel.

In the embodiment, the second horizontal load transfer plate 10 is a rectangular steel plate that is welded inside the upper column transfer member 4. The number of the second horizontal load transfer plate 10 is two, and these two second horizontal load transfer plates 10 are welded in the inner cavity of the lower column transfer member 11 in parallel.

A construction method for a prefabricated reinforced concrete beam-column connecting structure includes the following steps:

step 1: fabricating the lower prefabricated column 2, the upper prefabricated column 1 and the prefabricated beam 3, where during fabricating of the lower prefabricated column 2, the lower column transfer member 5 is sleeved on the top of the lower prefabricated column 2, and the upper end portion of the lower column main reinforcement 2.1 passes through the first perforations 8 in sequence and is anchored at the top of the uppermost first horizontal load transfer plate 7; during fabricating the upper prefabricated column 1, the upper column transfer member 4 is sleeved on the bottom of the upper prefabricated column 1, and the lower end portion of the upper column main reinforcement 1.1 passes through the second perforations 11 in sequence and is anchored at the bottom of the lowermost second horizontal load transfer plate 10, during fabricating of the prefabricated beam 3, the end portion of the beam upper main reinforcement 3.1 extends beyond the end surface of the beam concrete 3.4, and the exceeded part is bent downward, and the end portion of the beam lower main reinforcement 3.2 extends beyond the end surface of the beam concrete 3.4, and the exceed part is bent upward;

step 2: installing the lower prefabricated column 2 in place;

step 3: hoisting the upper prefabricated column 1 and aligning a bottom center of the upper prefabricated column 1 with a top center of the lower prefabricated column 2;

step 4: after determining that the upper prefabricated column 1 is positioned correctly, butt welding at a joint seam between the upper column transfer member 4 and the lower column transfer member 5;

step 5: pouring a joint concrete 16 from the upper end portion of the grouting pipe 15 into a cavity enclosed by the upper column transfer member 4 and the lower column transfer member 5;

step 6: connecting the connecting slot of beam main reinforcement 6 at a joint, corresponding to the prefabricated beam 3, on the upper column transfer member 4 and the lower column transfer member 5 by welding;

step 7: hoisting the prefabricated beam 3, and extending the bent section of the beam lower main reinforcement 3.2 and the bent section of the beam upper main reinforcement 3.1 into the connecting slot of beam main reinforcement 6; and step 8: pouring the joint post-casted concrete 18 into a formwork, and the construction is completed In the embodiment, the beam stirrup 3.3 are hooped outside the beam upper main reinforcement 3.1 and the beam lower main reinforcement 3.2, and constitutes the beam steel frame together with the beam upper main reinforcement 3.1 and the beam lower main reinforcement 3.2.

In an embodiment, in a case that the number of the connecting slot of beam main reinforcement 6 is two, in step 7, during construction, the bent section of the beam upper main reinforcement 3.1 is extended into the upper connecting slot of beam main reinforcement 6*a*, and the bent section of the beam lower main reinforcement 3.2 is extended into the lower connecting slot of beam main reinforcement 6*b*. If the pouring quality needs to be ensured, the third through holes 25 and the second through holes 24 can be sealed by sealant.

In the embodiment, in a case that the number of the connecting slot of beam main reinforcement 6 is one, in step 7, during construction, the bent section of the beam upper main reinforcement 3.1 is extended into the connecting slot of beam main reinforcement 6, and the bent section of the beam lower main reinforcement 3.2 is extended into the connecting slot of beam main reinforcement 6 through the first through holes 22. If the pouring quality needs to be ensured, the first through holes 22 can be sealed by sealant.

In the embodiment, in a case that a triangular groove is provided at an upper end portion of an outer surface of the lower column transfer member 5 along a top edge thereof and a triangular groove is provided at a lower end portion of an outer surface of the upper column transfer member 4 along a bottom edge thereof, the triangular groove at the top of the lower column transfer member 5 and the triangular groove at the bottom of the upper column transfer member 4 constitute a V-shaped groove. In step 4, a butted welding seam is welded in the V-shaped groove.

The above embodiments are not an exhaustive list of specific implementations, and other embodiments are possible. The object of the above embodiments is to illustrate the present application, but not to limit the scope of protection of the present application. All applications derived from simple changes of the present application fall within the scope of protection of the present application.

The invention claimed is:

1. A prefabricated reinforced concrete beam-column connecting structure, comprising an upper prefabricated column, a lower prefabricated column, and a prefabricated beam, wherein the upper prefabricated column comprises an upper column main reinforcement, an upper column stirrup and upper column concrete, the lower prefabricated column comprises a lower column main reinforcement, a lower column stirrup and lower column concrete, and the prefabricated beam comprises a beam upper main reinforcement, a beam lower main reinforcement, a beam stirrup, and a beam concrete, wherein the prefabricated reinforced concrete beam-column connecting structure further comprises an upper column transfer member, a lower column transfer member and a connecting slot of beam main reinforcement, wherein an upper end portion of the lower column main reinforcement extends beyond a top surface of the lower column concrete, and a part, extending beyond the lower column concrete, of the lower column main reinforcement is provided with a thread, a shape of a horizontal section of the lower column transfer member is adapted to a shape of a horizontal section the lower prefabricated column, and a lower end portion of the lower column transfer member is sleeved on an upper end portion of the lower prefabricated column, wherein first horizontal load transfer plates are arranged at intervals in a vertical direction inside the lower column transfer member, first perforations are formed at positions, corresponding to the lower column main reinforcement, on surfaces of the first horizontal load transfer plates, an upper end portion of the lower column main reinforcement passes through the first perforations in sequence and is anchored at a top of an uppermost one of the first horizontal load transfer plates by a first nut, and first grouting holes are formed at a middle of the surfaces of the first horizontal load transfer plates, wherein a lower end portion of the upper column main reinforcement extends beyond a bottom surface of the upper column concrete, and a part, extending beyond the upper column concrete, of the upper column main reinforcement is provided with a thread, wherein a shape of a horizontal section of the upper column transfer member is adapted to a shape of a horizontal section of the upper prefabricated column, and an upper end portion of the upper column transfer member is sleeved on a lower end portion of the upper prefabricated column, wherein second horizontal load transfer plates are arranged at intervals in a vertical direction inside the upper column transfer member, second perforations are formed at positions, corresponding to the upper column main reinforcement, on surfaces of the second horizontal load transfer plates, a lower end portion of the upper column main reinforcement passes through the second perforations in sequence and is anchored at a bottom of a lowermost one of the second horizontal load transfer plates by a second nut, and second grouting holes are formed at a middle of the surfaces of the second horizontal load transfer plates, wherein the upper column transfer member is arranged on a top of the lower column transfer member and is connected with the lower column transfer member by welding, a grouting pipe is pre-embedded in the upper column concrete, and a lower end portion of the grouting pipe passes through the first grouting holes in sequence and extends into a joint between the upper prefabricated column and the lower prefabricated column, wherein a joint concrete is poured into a cavity enclosed by the lower column transfer member, the upper column transfer member, the lower prefabricated column, and the upper prefabricated column, wherein the connecting slot of beam main reinforcement is connected to one side of the upper column transfer member and the lower column transfer member, the prefabricated beam is arranged on one side of a joint between the upper prefabricated column and the lower prefabricated column and at a position close to the connecting slot of beam main reinforcement, and an end portion of one side, close to the connecting slot of beam main reinforcement, of the beam upper main reinforcement and an end portion of one side, close to the connecting slot of beam main reinforcement, of the beam lower main reinforcement both extend beyond end portion faces of corresponding sides of the beam concrete, wherein the end portion of one side of the beam upper main reinforcement close to the connecting slot of beam main reinforcement is bent downward and extends into the connecting slot of beam main reinforcement, the end portion of one side of the beam lower main reinforcement close to the connecting slot of beam main reinforcement is bent upward and extend into the connecting slot of beam main reinforcement, shear bolts are provided at intervals on an outer surface of the connecting slot of beam main reinforcement, and a joint post-casted concrete is poured between the prefabricated beam and the lower column transfer member and between the prefabricated beam and the upper column transfer member.

2. The prefabricated reinforced concrete beam-column connecting structure according to claim 1, wherein a first anchoring plate is provided between the first nut and the top of the uppermost one of the first horizontal load transfer plates, and a second anchoring plate is provided between the second nut and the top of the lowermost one of the second horizontal load transfer plates.

3. The prefabricated reinforced concrete beam-column connecting structure according to claim 1, wherein the lower column transfer member is cylindrical, a triangular groove is formed at an upper end portion of an outer surface of the lower column transfer member along a top edge of the lower column transfer member, and the lower column transfer member has a height equal to h/2+b, wherein h is a height of the prefabricated beam, and b ranges from 20 mm to 500 mm.

4. The prefabricated reinforced concrete beam-column connecting structure according to claim 1, wherein the upper column transfer member is cylindrical, a triangular groove is formed at a lower end portion of an outer surface of the upper column transfer member along a bottom edge of the upper column transfer member, and the upper column transfer member has a height equal to h/2+b, wherein h is the height of the prefabricated beam, and b ranges from 20 mm to 500 mm.

5. The prefabricated reinforced concrete beam-column connecting structure according to claim 1, wherein the number of the connecting slot of beam main reinforcement is one, and the connecting slot of beam main reinforcement comprises a first bottom plate and a first side plate, wherein a horizontal section of the first side plate is in a horizontal-laying U shape, and an opening of the U shape of the first side plate faces towards one side of the lower column transfer member and the upper column transfer member, wherein an upper portion of the first side plate is connected to the upper column transfer member, a lower portion of the first side plate is connected to the lower column transfer member, a first arc-shaped gap is formed in a middle of a vertical edge, connected to the lower column transfer member and the upper column transfer member, of the first side plate, and a welded seam between the lower column transfer member and the upper column transfer member passes through the first arc-shaped gap, wherein the first bottom plate is configured to block a rectangular opening enclosed by a bottom edge of the first side plate and the lower column transfer member, first through holes are formed at intervals on the first bottom plate, and a bent section of the beam lower main reinforcement extends into the connecting slot of beam main reinforcement through the first through holes.

6. The prefabricated reinforced concrete beam-column connecting structure according to claim 5, wherein a transverse baffle is provided inside a cavity enclosed by the first side plate, the lower column transfer member, and the upper column transfer member, one end portion, close to the lower column transfer member and the upper column transfer member, of the transverse baffle is connected to the lower column transfer member and the upper column transfer member, and one end portion of the transverse baffle away from the lower column transfer member and the upper column transfer member extends beyond the first side plate, wherein the first side plate comprises a front side plate section and a rear side plate section, a second arc-shaped gap is formed at a position, corresponding to the first arc-shaped gap, on one side of the transverse baffle close to the lower column transfer member and the upper column transfer member, a welded seam between the lower column transfer member and the upper column transfer member passes through the first arc-shaped gap, a horizontal section of the front side plate section and a horizontal section of the rear side plate section each is in a horizontal-laying L shape, and the front side plate section and the rear side plate section are symmetrically arranged on two opposite sides of the transverse baffle, wherein one end portion of the front first side plate is connected to the lower column transfer member and the upper column transfer member, one end portion of the front side plate section is connected to a front side surface of the transverse baffle, one end portion of the rear first side plate is connected to the lower column transfer member and the upper column transfer member, the other end portion of the rear side plate section is connected to a rear side surface of the transverse baffle, and the shear bolts are connected to a part of the transverse baffle extending beyond the first side plate at intervals.

7. The prefabricated reinforced concrete beam-column connecting structure according to claim 1, wherein the number of the connecting slot of beam main reinforcement is two, which are a upper connecting slot of beam main reinforcement and a lower connecting slot of beam main reinforcement, the lower connecting slot of beam main reinforcement is connected to the lower column transfer member and comprises a second side plate and a second bottom plate, wherein a horizontal section of the second side plate is in a horizontal-laying U shape, and an opening of the U shape of the second side plate faces towards one side of the lower column transfer member, wherein the second bottom plate is arranged to block a rectangular opening formed by a bottom edge of the second side plate and the lower column transfer member, second through holes are formed at intervals on the second bottom plate, a bent section of the beam lower main reinforcement extends into the lower connecting slot of beam main reinforcement through the second through holes, wherein the upper connecting slot of beam main reinforcement is connected to the upper column transfer member and comprises a third side plate and a top plate, a horizontal section of the third side plate is in a horizontal-laying U shape, and an opening of the U shape of the third side plate faces towards one side of the upper column transfer member, wherein the top plate is arranged to block a rectangular opening enclosed by a top edge of the third side plate and the upper column transfer member, third through holes are formed at intervals on the top plate, and a bent section of the beam upper main reinforcement extends into the upper connecting slot of beam main reinforcement through the third through holes.

8. A construction method for a prefabricated reinforced concrete beam-column connecting structure according to claim 1, comprising the following steps:

step 1: fabricating the lower prefabricated column, the upper prefabricated column and the prefabricated beam, wherein, during fabricating of the lower prefabricated column, the lower column transfer member is sleeved on the top of the lower prefabricated column, and the upper end portion of the lower column main reinforcement passes through the first perforations in sequence and is anchored at the top of the uppermost one of the first horizontal load transfer plates, wherein, during fabricating the upper prefabricated column, the upper column transfer member is sleeved on the bottom of the upper prefabricated column, and the lower end portion of the upper column main reinforcement passes through the second perforations in sequence and is anchored at the bottom of the lowermost one of the second horizontal load transfer plate, wherein, during fabricating of the prefabricated beam, the end portion of the beam upper main reinforcement is extended beyond the end surface of the beam concrete, and an exceeding part of the beam upper main reinforcement is bent downward, wherein the end portion of the beam lower main reinforcement is extended beyond the end surface of the beam concrete, and an exceeding part of the beam lower main reinforcement is bent upward;

step 2: installing the lower prefabricated column in place;

step 3: hoisting the upper prefabricated column and aligning a center of the bottom surface of the upper prefabricated column with a center of the top surface of the lower prefabricated column;

step 4: determining that the upper prefabricated column is positioned correctly, then butt welding at a joint seam between the upper column transfer member and the lower column transfer member;

step 5: pouring the joint concrete from the upper end portion of the grouting pipe into a cavity enclosed by the upper column transfer member and the lower column transfer member;

step 6: connecting the connecting slot of beam main reinforcement at a joint, corresponding to the prefabricated beam, on the upper column transfer member and the lower column transfer member by welding;

step 7: hoisting the prefabricated beam, and extending the bent section of the beam lower main reinforcement and the bent section of the beam upper main reinforcement into the connecting slot of beam main reinforcement; and step 8: pouring the joint post-casted concrete into a formwork, and the construction is completed.

* * * * *